US009239548B2

(12) United States Patent
Tetsuno et al.

(10) Patent No.: US 9,239,548 B2
(45) Date of Patent: Jan. 19, 2016

(54) IMAGE FORMING APPARATUS

(71) Applicant: CANON KABUSHIKI KAISHA, Tokyo (JP)

(72) Inventors: Shuichi Tetsuno, Kawasaki (JP); Takahiro Ikeda, Saitama (JP); Yuta Isobe, Kawasaki (JP); Shunsuke Mizukoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/967,809

(22) Filed: Aug. 15, 2013

(65) Prior Publication Data

US 2014/0050499 A1 Feb. 20, 2014

(30) Foreign Application Priority Data

Aug. 20, 2012 (JP) ..... 2012-181853

(51) Int. Cl.
*G03G 15/00* (2006.01)
*G03G 15/16* (2006.01)
*G03G 21/00* (2006.01)

(52) U.S. Cl.
CPC ..... *G03G 15/161* (2013.01); *G03G 21/0041* (2013.01); *G03G 2215/1661* (2013.01); *G03G 2221/1621* (2013.01); *G03G 2221/1624* (2013.01); *G03G 2221/1627* (2013.01)

(58) Field of Classification Search
CPC ..... G03G 15/161; G03G 21/0041; G03G 2215/1661; G03G 2221/1621; G03G 2221/1624; G03G 2221/1627; G03G 2215/1621; G03G 2215/1624; G03G 2215/1627
USPC ..... 399/71, 101, 149, 150
See application file for complete search history.

(56) References Cited

U.S. PATENT DOCUMENTS 6,321,059 B1 * 11/2001 Tamura ..... G03G 15/0194 399/149
2001/0031159 A1 * 10/2001 Ogiyama ..... G03G 15/161 399/297
2011/0217060 A1 * 9/2011 Kawasaki et al. ..... 399/101
2013/0336670 A1 * 12/2013 Ikeda ..... G03G 21/0005 399/66

FOREIGN PATENT DOCUMENTS

JP 9-50167 A 2/1997

* cited by examiner

*Primary Examiner* — Ryan Walsh
(74) *Attorney, Agent, or Firm* — Canon USA Inc. IP Division

(57) ABSTRACT

An image forming apparatus, which executes, after an image forming operation is stopped, a cleaning operation in which toner that remains on an intermediate transfer belt is transferred to a photosensitive drum and is removed by a cleaning blade while the image forming apparatus causes the intermediate transfer belt to move for circulation, causes a charging roller or a laser scanner to change the surface potential of the photosensitive drum such that the toner to be transferred from the intermediate transfer belt to the photosensitive drum is part of the toner that is to remain on the intermediate transfer belt, when the cleaning operation is executed.

16 Claims, 11 Drawing Sheets

IMAGE FORMING APPARATUS

BACKGROUND OF THE INVENTION

1. Field of the Invention

The present invention relates to an image forming apparatus.

2. Description of the Related Art

Image forming apparatuses that form an image by primary-transferring a toner image, which is a developer image formed on a drum-type electrophotographic photosensitive member (hereinafter, referred to as a photosensitive drum), to an intermediate transfer member and by further secondary-transferring the primary-transferred toner image to a recording material (recording medium) are in practical use.

In obtaining a good image from an image forming apparatus which uses an intermediate transfer member, it is important to remove secondary transfer residual toner (residual toner), which remains on the intermediate transfer member and is untransferred from the intermediate transfer member to the recording material at the secondary transfer, from the intermediate transfer member before the next primary transfer is started.

Conventionally, the secondary transfer residual toner of the previous printing is removed by a cleaning method, which uses rubbing, before the primary transfer. According to the rubbing method, the toner is removed by a fur brush or a blade. The fur brush or the blade is provided at a position downstream of a secondary transfer unit of the intermediate transfer member and upstream of a primary transfer unit, in the moving direction of the intermediate transfer member.

If the cleaning method using the rubbing method is used, since the surface of the intermediate transfer member is scraped, the surface of the intermediate transfer member may be deteriorated or the toner may be easily fused and adhered to the intermediate transfer member. Further, since a dedicated container for collecting the removed secondary transfer residual toner is necessary, the image forming apparatus needs to have an extra space for the container. Thus, in recent years, a charging cleaning method discussed in Japanese Patent Application Laid-Open No. 9-50167 has been used to solve such a problem. According to the charging cleaning method, secondary transfer residual toner on an intermediate transfer member is collected in a cleaning device of a photosensitive drum.

Further, according to the charging cleaning method, the secondary transfer residual toner on the intermediate transfer member is charged opposite in polarity to the charging potential of the photosensitive drum by a charging unit provided downstream of a secondary transfer position in the rotational direction of intermediate transfer member and upstream of a primary transfer position. Thus, the secondary transfer residual toner is transferred to the photosensitive drum at the primary transfer portion.

The toner transferred to the photosensitive drum is collected by the cleaning device of the photosensitive drum. A common cleaning device of the photosensitive drum includes a cleaning blade (cleaning unit) which contacts the photosensitive drum and a waste toner container where the toner scraped from the photosensitive drum by the cleaning blade is collected.

According to the charging cleaning method, since the charging unit does not need to strongly contact and scrape the intermediate transfer member, deterioration of the surface of the intermediate transfer member and toner fusion to the intermediate transfer member can be prevented compared to the cleaning method employing the rubbing. Further, since the residual toner collected after the cleaning operation is collected in a waste toner container of the cartridge, it is not necessary to prepare a container dedicated for storing the collected residual toner. This contributes to reducing the size and cost of the image forming apparatus.

However, according to the charging cleaning method, if the cleaning blade of the photosensitive drum is to clean a large amount of toner to be received especially when the image forming apparatus is recovered from a paper jam during high quality printing in a low temperature environment, a defective image may be formed due to poor cleaning. According to the charging cleaning method, since the residual toner is charged to a polarity opposite to the polarity of the photosensitive drum, the residual toner tends to strongly adhere to the photosensitive drum due to static electric charge. If the cleaning blade is to scrape a large amount of such toner, the cleaning blade may be deformed and the toner may slip through the cleaning blade.

SUMMARY OF THE INVENTION

The present invention is directed to an image forming apparatus useful in preventing the occurrence of a defective image which occurs when a large amount of developer is conveyed to a cleaning unit at a time and the developer slips through the cleaning unit.

According to an aspect of the present invention, an image forming apparatus includes a charging unit configured to charge a surface of an image bearing member, a developing unit configured to form a developer image by supplying developer on the image bearing member, an intermediate transfer member configured to move for circulation, a primary transfer unit facing the image bearing member via the intermediate transfer member and configured to primary-transfer the developer image formed on the image bearing member to the intermediate transfer member, a secondary transfer unit configured to secondary-transfer the developer image primary-transferred to the intermediate transfer member to a recording medium, and a cleaning unit configured to remove the developer on the image bearing member, wherein the image forming apparatus executes, after the image forming operation is stopped, a cleaning operation, in which the developer that remains on the intermediate transfer member is transferred to the image bearing member and is removed by the cleaning unit while the image forming apparatus causes the intermediate transfer member to move for circulation, and wherein, when the cleaning operation is executed, one of the first charging unit and the exposure unit changes the surface potential of the image bearing member such that the developer to be transferred from the intermediate transfer member to the image bearing member is part of the developer that is to remain on the intermediate transfer member.

Further features of the present invention will become apparent from the following description of exemplary embodiments with reference to the attached drawings.

DESCRIPTION OF THE EMBODIMENTS

Configuration of Image Forming Apparatus

Figure 1:
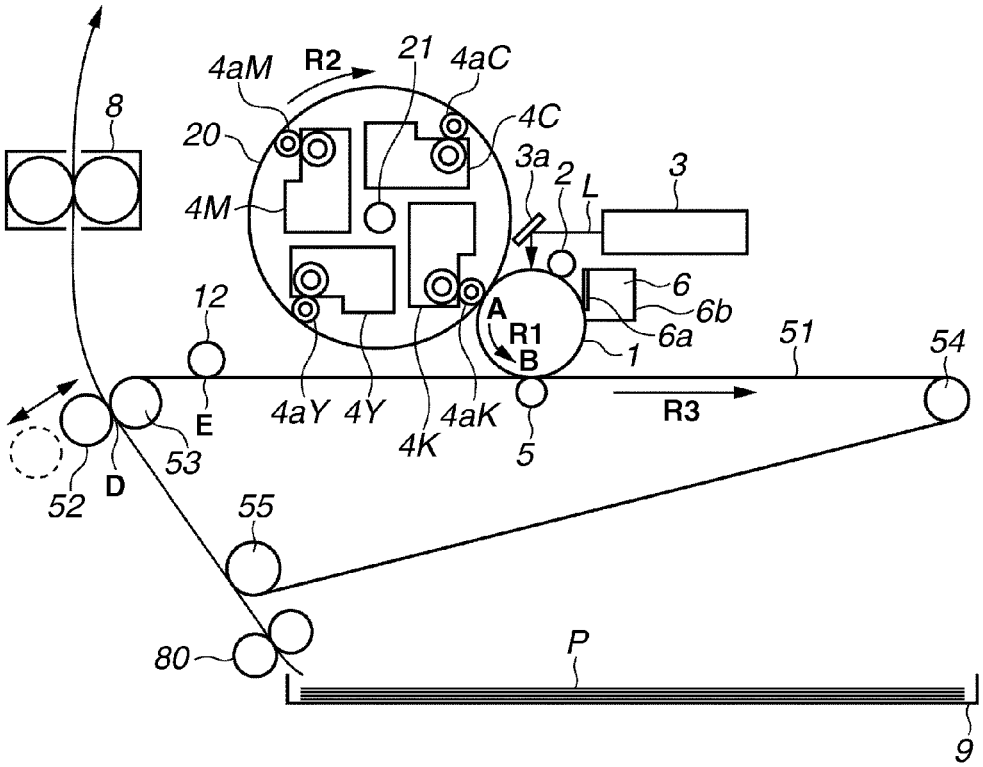
FIG. 1 is a schematic cross-sectional view of an image forming apparatus according to a first exemplary embodiment of the present invention.

First, a configuration of an image forming apparatus according to a first exemplary embodiment will be described with reference to FIG. 1. FIG. 1 is a schematic cross-sectional view of the image forming apparatus according to the first exemplary embodiment. According to the first exemplary embodiment, a four-color laser beam printer is described as an example of the image forming apparatus. However, the image forming apparatus is not limited to such a printer and the image forming apparatus may be, for example, a facsimile machine. Further, in the description below, each of suffixes Y, M, C, and K added to reference numerals and which denote the colors of the components are not used unless otherwise necessary.

The image forming apparatus according to the first exemplary embodiment includes a control unit (not illustrated) which performs transmission/reception of various types of electrical information between a host apparatus such as an image reader, a personal computer, or a facsimile machine, and performs overall control of the image forming operation according to a predetermined control program or the like. Based on an electrical image signal input to the control unit from the host apparatus, the image forming apparatus can form an image on a recording material P, which is a sheet-type recording medium, at a speed of 100 mm/sec.

As illustrated in FIG. 1, the image forming apparatus according to the first exemplary embodiment includes a drum-type electrophotographic photosensitive member (hereinafter, simply referred to as a photosensitive drum) 1 as an image bearing member. Further, the image forming apparatus includes a charging roller 2 as a first charging unit, a laser scanner 3 as an exposure unit, a developing unit 4, a primary transfer roller 5 as a primary transfer unit, and a cleaning device 6. These are processing units of the photosensitive drum 1. Furthermore, the image forming apparatus according to the first exemplary embodiment includes an intermediate transfer belt as an intermediate transfer member, and a secondary transfer roller 52 as a secondary transfer unit. Further, the image forming apparatus according to the first exemplary embodiment includes a fixing unit 8 and a sheet cassette 9, which stores the recording material P.

The photosensitive drum 1 rotates at a predetermined speed in a direction (counterclockwise direction) indicated by an arrow R1 in FIG. 1. The charging roller 2 contacts the photosensitive drum 1 and uniformly charges the surface of the photosensitive drum 1 when an image is formed. According to the first exemplary embodiment, the charging roller 2 is connected to a charging roller bias power supply (not illustrated). The surface of the photosensitive drum 1 is charged to a negative polarity by the charging roller 2.

The laser scanner 3 outputs a laser beam L, which is modulated according to image information of each color input to the control unit (not illustrated) from the host apparatus. The laser beam L is reflected by a reflection mirror 3*a*. Accordingly, the surface of the photosensitive drum 1, which is uniformly charged, is exposed to the laser beam L. In this manner, a latent image is formed on the surface of the photosensitive drum 1.

The developing unit 4 visualizes the latent image formed on the photosensitive drum 1 and forms a toner image as a developer image. As illustrated in FIG. 1, the image forming apparatus according to the first exemplary embodiment includes developing units 4Y, 4M, 4C, and 4K which contain toner of four colors (yellow (Y), magenta (M), cyan (C), and black (K)), respectively. According to the first exemplary embodiment, a reversal development method employing contact developing using nonmagnetic toner is used. This toner is negatively charged in the normal polarity. The normal polarity is the charging polarity of the toner when the toner is used for development (when image forming is performed). As is the case with the first exemplary embodiment, if reversal development is to be performed on the photosensitive drum 1 which is negatively charged, the normal polarity will be negative.

According to the first exemplary embodiment, the developing units 4Y to 4K are stored in a rotary 20 as a developing unit holding unit. Further, each of the developing units 4Y to 4K is removably attached to a mounting unit in the rotary 20. The rotary 20 rotates in a direction (clockwise direction) indicated by an arrow R2 in FIG. 1 around a central axis 21 by drive of a driving unit such as a motor (not illustrated).

Each of the developing units 4Y to 4K is mounted such that it can contact the photosensitive drum 1 and includes a developing roller 4*a* as a developing unit which bears toner. In the description below, the position where the developing roller 4*a* of the developing unit 4 attached to the rotary 20 faces and contacts the photosensitive drum 1 is referred to as a development position A. In other words, the developing unit 4 supplies toner for the photosensitive drum 1 (image bearing member) at the development position A. According to the rotation of the rotary 20, each of the developing units 4Y to 4K sequentially moves to the development position A and supplies toner of each color to the surface of the photosensitive drum 1.

The primary transfer roller 5 faces the photosensitive drum 1 via the intermediate transfer belt 51. The toner image formed on the photosensitive drum 1 is primary-transferred to the intermediate transfer belt 51 by the primary transfer roller 5. A position where the primary transfer is performed is referred to as a primary transfer nip portion B.

As illustrated in FIG. 1, the intermediate transfer belt 51 is stretched by a secondary transfer counter roller 53, a drive roller 54, and a tension roller 55, and supported in the image forming apparatus. The intermediate transfer belt 51 is movable for rotation in a direction (clockwise direction) indicated by an arrow R3 in FIG. 1. Further, according to the first exemplary embodiment, the intermediate transfer belt 51 is a flexible member and a dielectric material. The intermediate transfer belt 51 has a perimeter that allows image forming of an image corresponding to a maximum sheet size (A4 size) of the recording material P.

The secondary transfer roller 52 secondary-transfers the toner image formed on the intermediate transfer belt (intermediate transfer member) 51 to the recording material P. A secondary transfer bias of a polarity (in other words, positive polarity) opposite to the charging polarity of the toner when the image forming is performed is applied to the secondary transfer roller 52.

Further, according to the image forming apparatus of the first exemplary embodiment, the secondary transfer counter roller 53 is provided facing the secondary transfer roller 52 via the intermediate transfer belt 51. The secondary transfer roller 52 is moved between an acting position and a non-acting position by a rocking mechanism (not illustrated). The acting position is the position where the secondary transfer roller 52 acts with the secondary transfer counter roller 53 via the intermediate transfer belt 51. The non-acting position (indicated by the broken line in FIG. 1) is a position away from the surface of the intermediate transfer belt 51 where the secondary transfer roller 52 does not act with the secondary transfer counter roller 53. The portion where the secondary transfer is performed is a secondary transfer nip portion D.

The secondary transfer roller 52 is at the non-acting position when the toner image is primary-transferred to the photosensitive drum 1 by the primary transfer roller 5. Then, before the leading edge of the unfixed toner image of four colors formed on the intermediate transfer belt 51 reaches the secondary transfer nip portion D with the rotation of the intermediate transfer belt 51, the secondary transfer roller 52 moves to the acting position. While the recording material P passes the secondary transfer nip portion D, the superimposed toner image of four colors on the intermediate transfer belt 51 is secondary-transferred to the recording material P by one operation.

Subsequently, the recording material P is separated from the surface of the intermediate transfer belt 51 and conveyed to the fixing unit 8. With an application of heat and pressure at a fixing nip portion of the fixing unit 8, the toner is fused and the colors are mixed. Thus, the color toner image is fixed to the recording material P.

The cleaning device 6 includes a cleaning blade 6*a* as a cleaning unit which removes the toner on the photosensitive drum 1, and a waste toner container 6*b*. The cleaning blade 6*a* is formed by a blade supporting plate, which is made of a metal plate and whose edge is covered with polyurethane rubber. The cleaning blade 6*a* is supported by the waste toner container 6*b*. Further, the cleaning blade 6*a* contacts the photosensitive drum 1 in the direction opposite to the rotational direction of the photosensitive drum 1. The toner scraped and removed from the photosensitive drum 1 by the cleaning blade 6*a* is collected in the waste toner container 6*b* as waste toner.

According to the first exemplary embodiment, a toner charging roller 12, as a second charging unit, is a solid roller having a single layer. The toner charging roller 12 is located downstream of the secondary transfer nip portion D and upstream of the primary transfer nip portion B in the moving direction for circulation of the intermediate transfer belt 51. The toner charging roller 12 charges the toner that passes the toner charging roller 12 by the movement of the intermediate transfer belt 51. The portion where the toner is charged is a toner charging position E illustrated in FIG. 1. A toner charging roller bias power supply (not illustrated) is connected to the toner charging roller 12.

(Charging Cleaning Operation after Secondary Transfer)

Removing processing of the toner that remains on the intermediate transfer belt 51 according to the first exemplary embodiment will be described. After the toner image is secondary-transferred from the intermediate transfer belt 51 to the recording material P, the secondary transfer residual toner remains on the surface of the intermediate transfer belt 51. This is because some toner particles of the toner image formed on the intermediate transfer belt 51 are charged to positive polarity, which is opposite to the normal polarity, when the secondary transfer is performed. Such toner particles are not secondary-transferred to the recording material P.

Thus, according to the first exemplary embodiment, a charging cleaning operation is performed. According to the charging cleaning operation, the toner on the intermediate transfer belt 51 is electrostatically transferred to the photosensitive drum 1. More precisely, the polarity of the secondary transfer residual toner on the intermediate transfer belt 51 that remains after the secondary transfer is reversed to the polarity opposite to the normal polarity by the toner charging roller 12, so that the toner can be electrostatically transferred to the photosensitive drum 1. Then, the toner transferred to the photosensitive drum 1 is removed by the cleaning blade 6*a* that contacts the photosensitive drum 1.

More precisely, immediately after the secondary transfer is finished, while the rotation driving of the intermediate transfer belt 51 is continuously performed, a bias of positive polarity is applied to the toner charging roller 12 due to power supplied from the toner charging roller bias power supply. The toner charging roller 12 constantly contacts the intermediate transfer belt 51. When a portion of the intermediate transfer belt 51 having the secondary transfer residual toner passes the toner charging position E, the secondary transfer residual toner of that portion is charged to positive polarity.

Further, when a bias of positive polarity is applied to the toner charging roller 12, simultaneously, a bias of negative polarity is applied to the charging roller 2 due to power supplied from the charging roller bias power supply. Thus, the surface of the photosensitive drum 1 is charged to negative polarity. Further, an electrostatic force that attracts the toner charged to positive polarity and reached the primary transfer nip portion B due to the movement of the intermediate transfer belt 51 to the photosensitive drum 1 acts on the toner.

With this electrostatic force, the secondary transfer residual toner on the intermediate transfer belt 51 is transferred to the photosensitive drum 1. When the photosensitive drum 1 rotates, the toner is conveyed to the cleaning device 6 and removed by the cleaning blade 6*a*. The removed toner is collected as waste toner in the waste toner container 6*b*.

Then, at timing the intermediate transfer belt 51 rotates one turn from the end of the secondary transfer, each of the bias application to the toner charging roller 12 and the charging roller 2 is stopped and the rotation driving of the intermediate transfer belt 51 is also stopped. Then, the charging cleaning operation ends.

(Charging Cleaning Operation after Emergency Stop of Image Forming Operation)

Next, the charging cleaning operation for removing the residual toner that remains on the intermediate transfer belt 51 in a case where emergency stop of the image forming operation occurs will be described. As illustrated in FIG. 1, the image forming apparatus according to the first exemplary embodiment includes a registration sensor 80 which detects the presence of the recording material P. The registration sensor 80 is provided between the sheet cassette 9 and the secondary transfer nip portion D in the conveying direction of the recording material P, and is used for the positional alignment of the toner image formed on the recording material P and the intermediate transfer belt 51.

If the registration sensor 80 is unable to detect the recording material P even if a predetermined period of time has elapsed from the start of the image forming operation, the control unit determines that a paper feed jam (the recording material P is not fed from the sheet cassette 9) or a no-paper jam (the recording material P is not set in the sheet cassette 9) has occurred, and urgently stops the image forming operation. The image forming apparatus according to the first exemplary embodiment includes a stopping unit (not illustrated) which can stop the image forming operation when the operation is in process.

Since the detection timing of the paper jam by the registration sensor 80 is after the start of the primary transfer and before the start of the secondary transfer, the image forming operation will be stopped in a state where the toner image is formed on the intermediate transfer belt 51. As described above, this toner that remains on the intermediate transfer belt 51 is transferred to the photosensitive drum 1 and removed by the cleaning blade 6*a*.

However, if the image forming operation is stopped in an urgent manner, a large amount of toner exists on the intermediate transfer belt 51 compared to the amount of secondary transfer residual toner that remains on the intermediate transfer belt 51 after the secondary transfer. If this large amount of toner is transferred to the photosensitive drum 1 at a time to be conveyed and cleaned by the cleaning blade 6*a*, poor cleaning may occur. This is because, when a large amount of toner is to be received by the cleaning blade 6*a* at a time, deforming of the cleaning blade tends to occur. Then, the toner may slip through the cleaning blade 6*a*.

Thus, according to the first exemplary embodiment, when the charging cleaning operation is performed, the surface potential of the photosensitive drum 1 is changed at predetermined intervals so that the toner which is to be transferred to the photosensitive drum 1 while the intermediate transfer belt 51 rotates one turn becomes a part of the toner that remains on the intermediate transfer belt 51. In addition to a case where a paper jam is detected, the emergency stop of the image forming operation is performed when the user turns off the power of the image forming apparatus or the user opens/closes the door of the apparatus, during the image forming operation.

(Sequence after Emergency Stop of Image Forming Operation)

Figure 2:
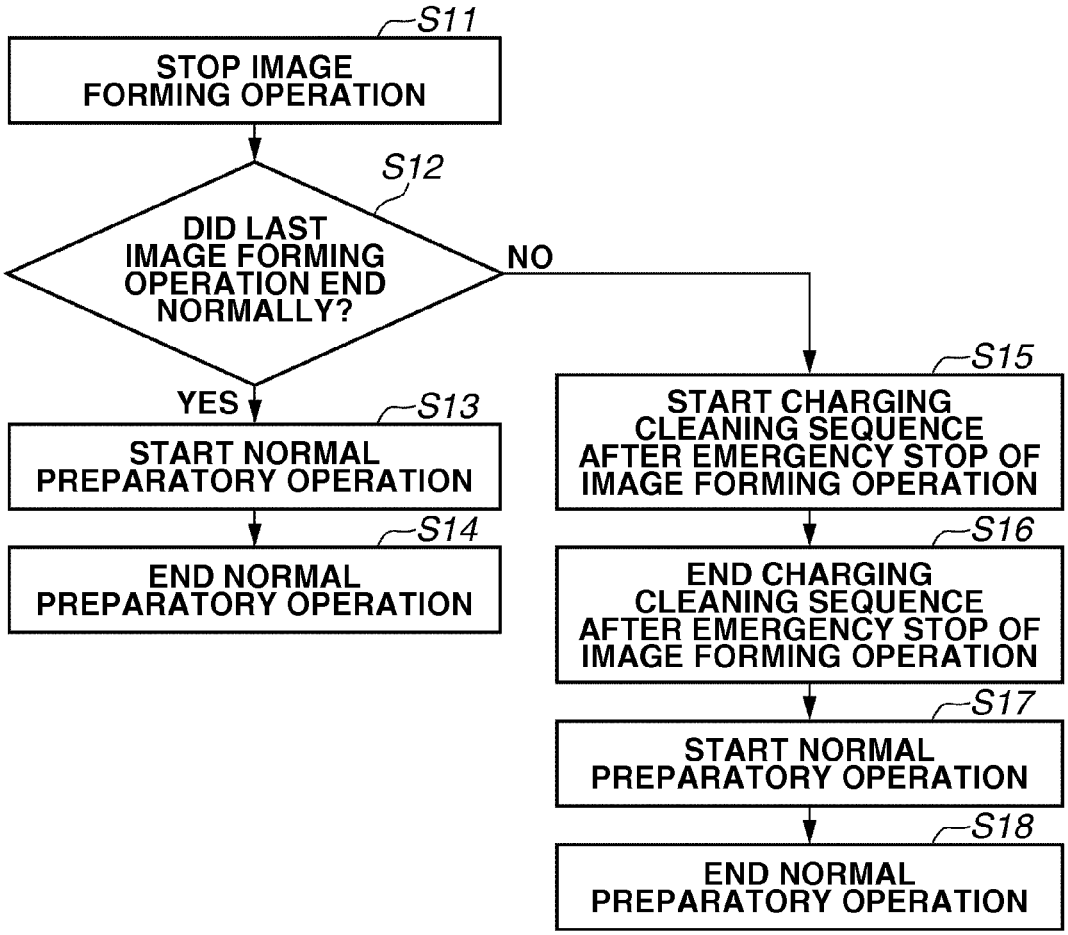
FIG. 2 is a flowchart illustrating a sequence after an emergency stop of an image forming operation of the image forming apparatus.

A sequence after the emergency stop of the image forming operation according to the first exemplary embodiment will be described with reference to FIG. 2. FIG. 2 is a flowchart illustrating the sequence after the emergency stop of the image forming operation according to the first exemplary embodiment.

In step S11, the image forming operation is stopped by the user turning off/on the power of the image forming apparatus or the user opening/closing the door of the apparatus. In step S12, based on history of a memory unit (not illustrated), the control unit (not illustrated) determines whether the last image forming operation has ended normally. If the operation has ended normally (YES in step S12), the processing proceeds to step S13. In step S13, the control unit starts the normal preparatory operation of the image forming apparatus. In step S14, the control unit ends the preparatory operation and the image forming apparatus will be ready for printing.

On the other hand, in step S12, if the image forming operation has not ended normally (NO in step S12), the processing proceeds to step S15. In step S15, the control unit starts the charging cleaning sequence after emergency stop of the image forming operation. In step S16, the control unit stops the charging cleaning sequence. In step S17, the control unit starts the normal preparatory operation. In step S18, the control unit ends the normal preparatory operation, and the image forming apparatus will be ready for printing.

(Charging Cleaning Operation after Emergency Stop of Image Forming Operation)

Figure 3:
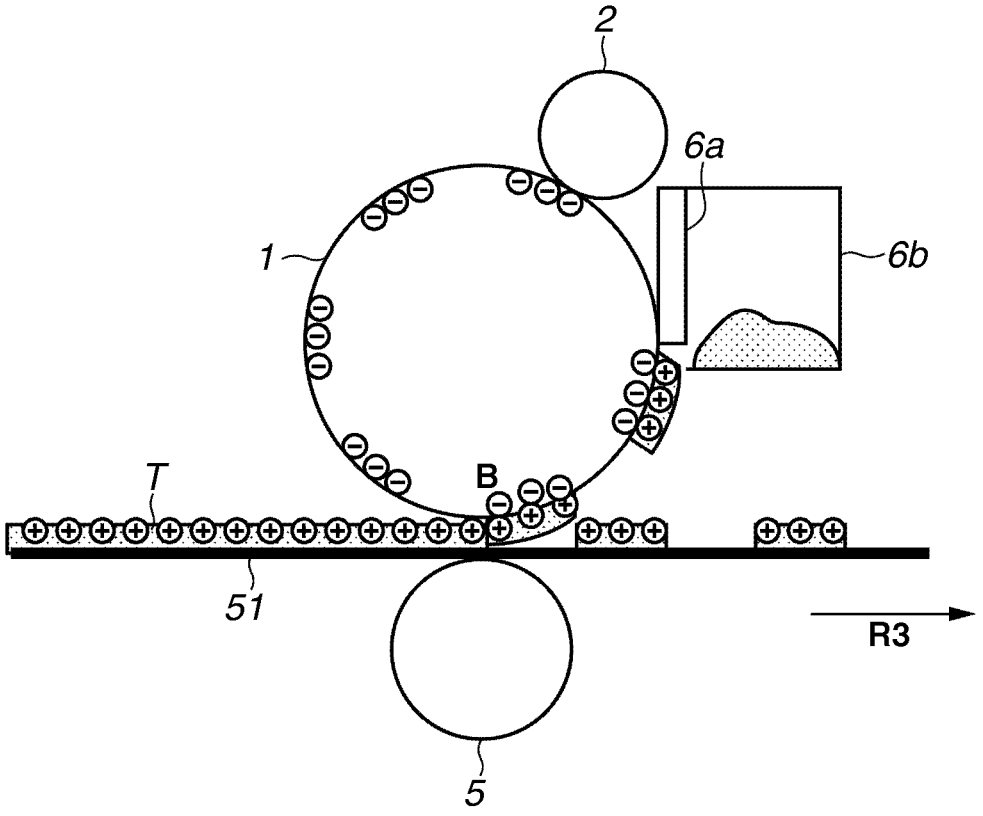
FIG. 3 schematically illustrates transfer of residual toner on an intermediate transfer belt to a photosensitive drum.

Next, by referring to FIGS. 1 and 3, the charging cleaning operation according to the first exemplary embodiment will be described. FIG. 3 schematically illustrates the transfer of residual toner T on the intermediate transfer belt to the photosensitive drum 1.

According to the first exemplary embodiment, after the image forming operation is stopped, the rotation driving of the intermediate transfer belt 51 is started, and a bias of +2000 V is applied to the toner charging roller 12 until the end of one turn of the intermediate transfer belt 51. Thus, the residual toner T that remains on the intermediate transfer belt 51 is charged to positive polarity when it passes the toner charging position E (see FIG. 1).

On the other hand, a bias of negative polarity is applied to the charging roller 2 at a predetermined ON/OFF cycle (0.01 second ON and 0.01 second OFF). According to the first exemplary embodiment, since the rotation speed of the photosensitive drum 1 is 100 mm/sec, the areas charged/not charged to negative polarity on the photosensitive drum 1 are formed at intervals of 1 mm in the rotational direction of the photosensitive drum 1.

As illustrated in FIG. 3, due to the movement of the intermediate transfer belt 51 in the direction of the arrow R3, after the residual toner T that remains on the intermediate transfer belt 51 is charged to positive polarity at the toner charging position E, the residual toner T is conveyed to the primary transfer nip portion B. When a portion of the surface of the photosensitive drum 1 which is charged to negative polarity reaches the primary transfer nip portion B, substantially all the residual toner T charged to positive polarity is transferred to the photosensitive drum 1 by an electrostatic force. On the other hand, when a portion of the surface of the photosensitive drum 1 which is not charged reaches the primary transfer nip portion B, since an electrostatic force is not substantially generated between the photosensitive drum 1 and the residual toner T, the residual toner T on the intermediate transfer belt 51 remains on the photosensitive drum 1 without being transferred.

In this manner, after the emergency stop of the image forming operation, the residual toner T on the intermediate transfer belt 51 is repeatedly transferred/not-transferred to the photosensitive drum 1 at the intervals of 1 mm in the rotational direction of the photosensitive drum 1 until the end of one turn of the intermediate transfer belt 51. Thus, until the end of one turn of the intermediate transfer belt 51, the cleaning blade 6*a* removes/does not remove the toner from the photosensitive drum 1 in an alternating manner at the intervals of 1 mm. Thus, until the end of one turn of the intermediate transfer belt 51, the cleaning blade 6*a* does not need to receive a large amount of the residual toner T at a time. Further, until the end of one turn of the intermediate transfer belt 51, the residual toner T untransferred to the photosensitive drum 1 exists at the intervals of 1 mm on the intermediate transfer belt 51.

Then, from the end of one turn to the end of two turns of the intermediate transfer belt 51, as is the case with the first turn of the intermediate transfer belt 51, a bias of +2000 V is applied to the toner charging roller 12, and the residual toner T on the intermediate transfer belt 51 is charged to positive polarity. On the other hand, a bias of −1000 V is constantly applied to the charging roller 2. Thus, the surface of the photosensitive drum 1 is constantly charged to negative polarity. Accordingly, by an electrostatic force that acts between the photosensitive drum 1 and the residual toner T, all the residual toner T on the intermediate transfer belt 51 is transferred to the photosensitive drum 1 at the primary transfer nip portion B.

At this time, since the residual toner T exists on the intermediate transfer belt 51 at the intervals of 1 mm in the rotational direction of the intermediate transfer belt 51, the cleaning blade 6*a* repeatedly removes/does not remove the toner from the photosensitive drum 1 at the intervals of 1 mm in an alternating manner. Thus, until the end of two turns from the end of one turn of the intermediate transfer belt 51, a large amount of the residual toner T to be received by the cleaning blade 6*a* at a time can also be prevented.

At the timing the two turns of the intermediate transfer belt 51 ends, each of the bias application to the charging roller 2 and the toner charging roller 12 is stopped. Further, immediately after the bias application is stopped, the rotation driving of the intermediate transfer belt 51 is stopped and the charging cleaning operation ends.

(Charging Cleaning Sequence after Emergency Stop of Image Forming Operation)

Figure 4:
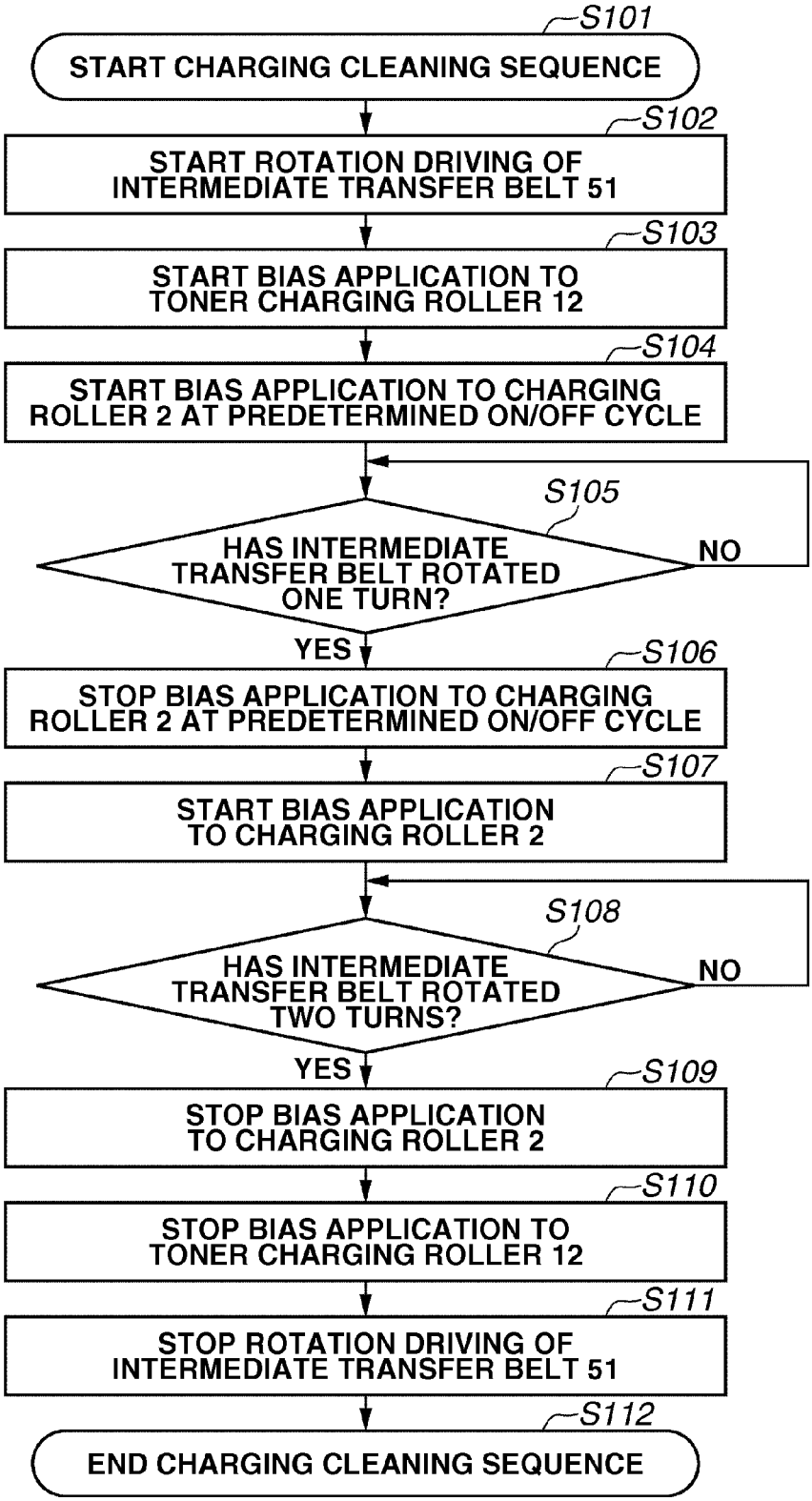
FIG. 4 is a flowchart illustrating a charging cleaning sequence according to the first exemplary embodiment.

Next, the charging cleaning sequence (steps S15 and S16 in FIG. 2) after the emergency stop of the image forming operation according to the first exemplary embodiment will be described with reference to FIG. 4. FIG. 4 is a flowchart illustrating the charging cleaning sequence according to the first exemplary embodiment. In step S101, the charging cleaning sequence is started after the emergency stop of the image forming operation. In step S102, the control unit starts the rotation driving of the intermediate transfer belt 51. In step S103, the control unit starts an application of a bias of +2000 V to the toner charging roller 12. In step S104, immediately after the application of the bias to the toner charging roller 12 is started, the control unit starts the application of the bias of −1000 V to the charging roller 2 at an ON/OFF cycle (0.01 second ON and 0.01 second OFF).

In step S105, the control unit determines whether the intermediate transfer belt 51 has rotated one turn after the start of the charging cleaning sequence. If the control unit determines that the intermediate transfer belt 51 has rotated one turn (YES in step S105), the processing proceeds to step S106. In step S106, the control unit stops the bias application to the charging roller 2 at the ON/OFF cycle. In step S107, immediately after the bias application is stopped, the control unit starts to constantly apply a bias of −1000 V to the charging roller 2. On the other hand, in step S105, if the control unit determines that the intermediate transfer belt 51 has not yet rotated one turn (NO in step S105), step S105 is repeated.

In step S108, the control unit determines whether the intermediate transfer belt 51 has rotated two turns after the start of the charging cleaning sequence. If the control unit determines that the intermediate transfer belt 51 has rotated two turns (YES in step S108), the processing proceeds to step S109. If the control unit determines that the intermediate transfer belt 51 has not yet rotated two turns (NO in step S108), step S108 is repeated. In step S109, the control unit stops the application of the bias to the charging roller 2. In step S110, the control unit stops the application of the bias to the toner charging roller 12. In step S111, the control unit stops the rotation driving of the intermediate transfer belt 51. In step S112, the charging cleaning sequence ends.

As described above, according to the first exemplary embodiment, since a large amount of toner to be received by the cleaning blade 6*a* at a time can be prevented, the toner that slips through the cleaning blade 6*a* can be prevented. Further, according to the first exemplary embodiment, since the toner is intermittently received by the cleaning blade at predetermined intervals, the toner that slips through the cleaning blade 6*a* due to the edge of the cleaning blade 6*a* being bent in the rotational direction of the photosensitive drum 1 by toner pressure can be prevented. As a result, the occurrence of a defective image due to poor cleaning can be reduced.

Figure 5:
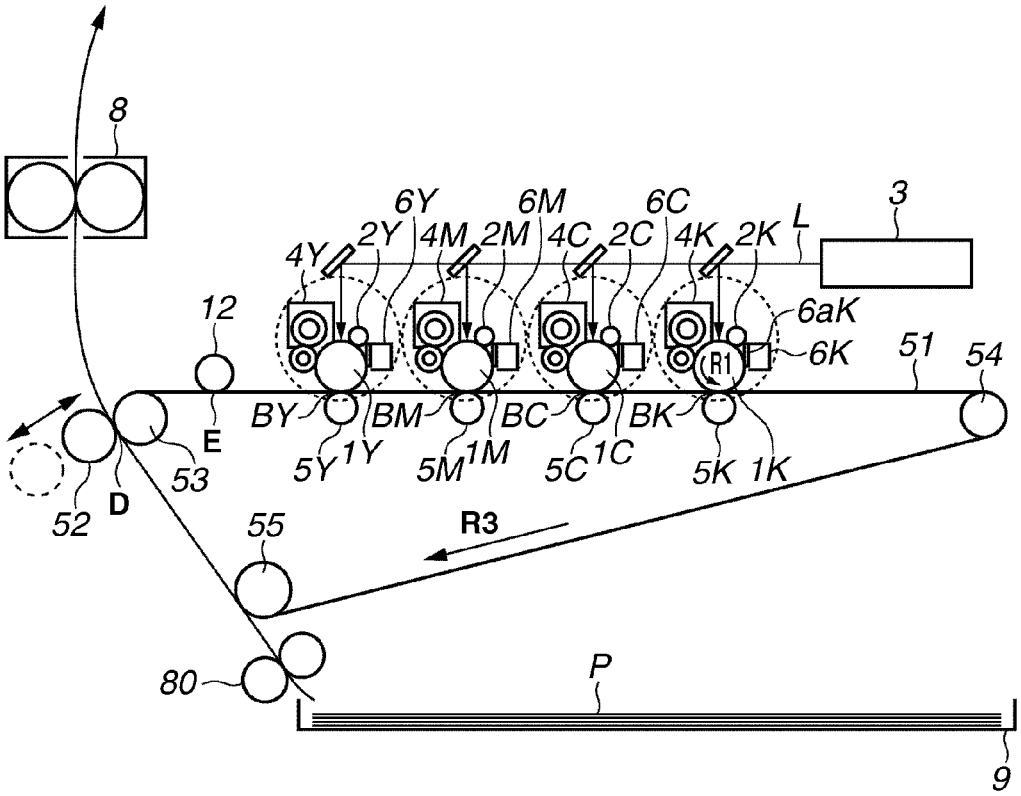
FIG. 5 is a schematic cross-sectional view of the image forming apparatus according to a second and a third exemplary embodiments.

Next, the image forming apparatus according to a second exemplary embodiment will be described with reference to FIG. 5. FIG. 5 is a schematic cross-sectional view of the configuration of the image forming apparatus according to the second exemplary embodiment. According to the second exemplary embodiment, as indicated by the dotted circles in FIG. 5, the image forming apparatus uses cartridges each of which includes the photosensitive drum 1, the charging roller 2, the developing unit 4, and the cleaning device 6. The cartridges used for the image forming apparatus are a Y cartridge which contains yellow toner Y, an M cartridge which contains magenta toner M, a C cartridge which contains cyan toner C, and a K cartridge which contains black toner K.

Each of these cartridges are removable and attached to the image forming apparatus main body in the order of the Y cartridge, the M cartridge, the C cartridge, and the K cartridge in the moving direction for circulation (in the direction of the arrow R3 in FIG. 5) of the intermediate transfer belt 51. Further, primary transfer rollers 5Y, 5M, 5C, and 5K contact the photosensitive drums 1Y, 1M, 1C, and 1K, respectively, via the intermediate transfer belt 51. Components similar to those described in the first exemplary embodiment are denoted by the same reference numerals and their descriptions are not repeated.

According to the second exemplary embodiment, by turning on/off the bias application to each of charging rollers 2Y to 2C, the residual toner T on the intermediate transfer belt 51 can be intermittently transferred to the photosensitive drums 1Y to 1K, respectively. Thus, when the residual toner T on the intermediate transfer belt 51 is transferred to the photosensitive drums, it is distributed to each of the photosensitive drums 1Y to 1K. Thus, all the residual toner T on the intermediate transfer belt 51 is collected by one turn of the intermediate transfer belt 51.

(Charging Cleaning Operation after Emergency Stop of Image Forming Operation)

Details of the charging cleaning operation according to the second exemplary embodiment will be described with reference to FIGS. 6A, 6B, 6C, and 6D. FIGS. 6A to 6D schematically illustrate the transfer of the residual toner T on the intermediate transfer belt to each of the photosensitive drums 1Y, 1M, 1C, and 1K.

First, the rotation driving of the intermediate transfer belt 51 is started. Immediately after the start of the rotation driving, a bias of positive polarity is applied to the toner charging roller 12. Accordingly, the residual toner T on the intermediate transfer belt 51 is charged to positive polarity at the toner charging position E.

Further, a bias is applied to each of the charging rollers 2Y to 2C at an ON/OFF cycle (0.01 second ON and 0.03 seconds OFF). Then, a portion charged to negative polarity having a width of 1 mm and a portion not charged to negative polarity having a width of 3 mm are formed on the photosensitive drums 1Y to 1K in an alternating manner in the rotational direction of the photosensitive drum 1. Thus, the residual toner T on the intermediate transfer belt 51 is transferred/not transferred onto the photosensitive drums 1Y to 1C in the rotational direction of the photosensitive drum 1 at a cycle (transferred corresponding to the width of 1 mm and not transferred corresponding to the width of 3 mm).

Further, a bias of −1000 V is constantly applied to the charging roller 2K and the surface of the photosensitive drum 1K is constantly charged to negative polarity. Thus, when the toner on the intermediate transfer belt 51 reaches a primary transfer position BK, the toner is constantly transferred to the photosensitive drum 1K.

The timing the bias is applied to the charging rollers is delayed by 0.71 seconds in the order of the charging rollers 2Y, 2C, 2M, and 2K. According to the second exemplary embodiment, since the rotation speed of the intermediate transfer belt 51 is 100 mm/sec, the intermediate transfer belt 51 proceeds 71 mm for 0.71 seconds. That is, for example, the bias application to the charging roller 2M of the M cartridge is started when the intermediate transfer belt 51 proceeded 71 mm from the timing the bias application to the charging roller 2Y of the Y cartridge has been started. In other words, the transfer of the residual toner T to the photosensitive drum 1M is started when the intermediate transfer belt 51 proceeds 71 mm from the start of the transfer of the residual toner T to the photosensitive drum 1Y.

The reason for delaying the timing of the bias application to the charging rollers in the order of the charging rollers 2Y, 2C, 2M, and 2K by 0.71 seconds is to prevent the portions of the toner to be transferred to each of the photosensitive drums 1Y, 1M, 1C, and 1K from overlapping in the moving direction of the intermediate transfer belt 51.

Figure 6A:
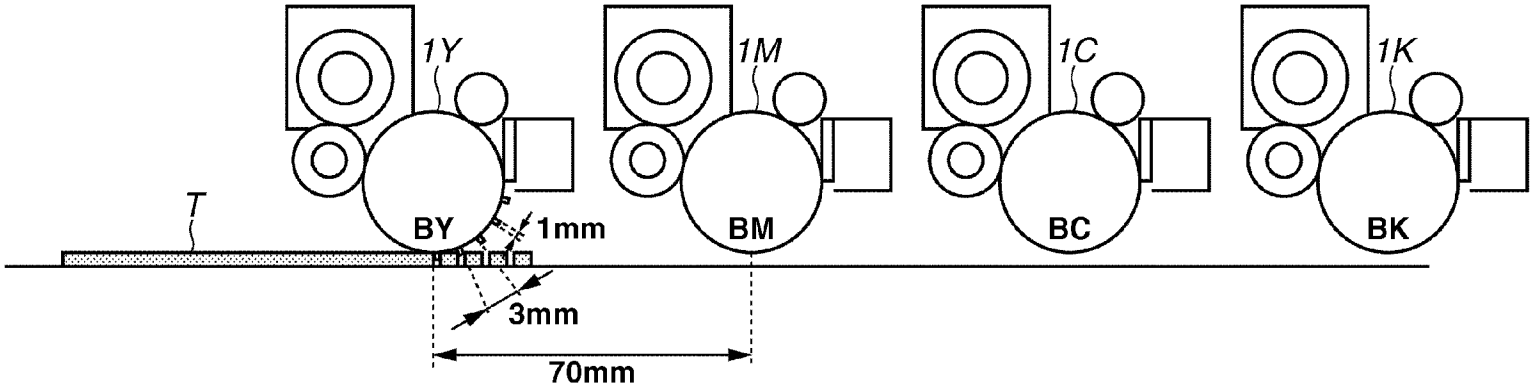
FIGS. 6A, 6B, 6C, and 6D schematically illustrate transfer of the residual toner on the intermediate transfer belt to each photosensitive drum.

First, as illustrated in FIG. 6A, some of the residual toner T on the intermediate transfer belt 51 is transferred to the photosensitive drum 1Y. More precisely, a cycle including transfer and non-transfer of the residual toner T is repeated. According to the cycle, the residual toner T corresponding to a length of 1 mm in the moving direction of the intermediate transfer belt 51 is transferred to the surface of the photosensitive drum 1Y from the intermediate transfer belt 51 at a primary transfer nip portion BY, and the residual toner T corresponding to a length of 3 mm in the moving direction of the intermediate transfer belt 51 is not transferred to the surface of the photosensitive drum 1Y at the primary transfer nip portion BY.

Figure 6B:
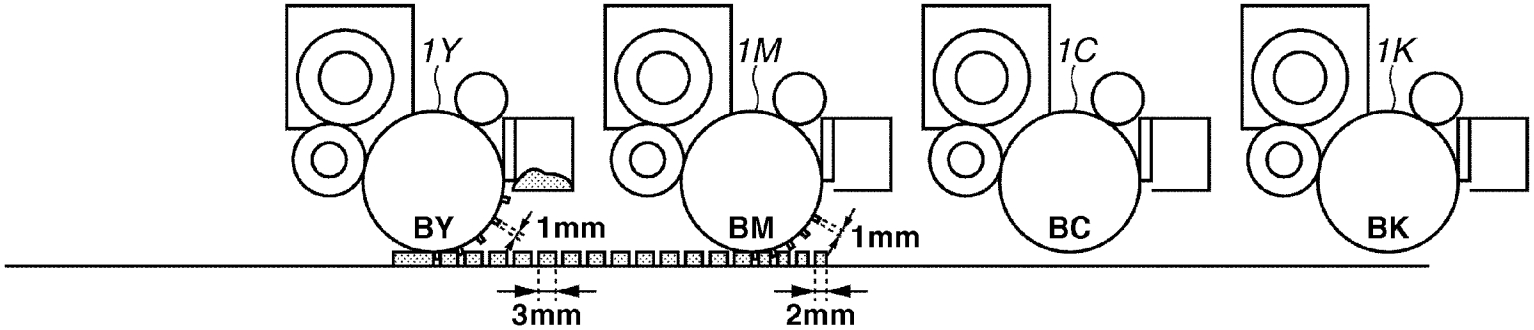

Further, as illustrated in FIG. 6B, some of the residual toner T not transferred to the photosensitive drum 1 at the primary transfer nip portion BY is transferred to the photosensitive drum 1M at a primary transfer nip portion BM. According to the second exemplary embodiment, the distance between adjacent primary transfer nip portions B is 70 mm. Thus, the distance between the primary transfer nip portion BY and the primary transfer nip portion BM is 70 mm.

As described above, the bias application to the charging roller 2M of the M cartridge is started when the intermediate transfer belt 51 proceeds 71 mm due to the rotation driving after the transfer of the toner to the photosensitive drum 1Y has been started. Further, out of the residual toner T on the intermediate transfer belt 51, the residual toner T corresponding to 1 mm at the most downstream position in the moving direction of the intermediate transfer belt 51 is transferred to the photosensitive drum 1Y. In other words, after the toner is transferred to the photosensitive drum 1Y, the toner that remains at the most downstream position of the intermediate transfer belt 51 is transferred to the photosensitive drum 1M. Thus, as illustrated in FIG. 6B, out of the residual toner T on the intermediate transfer belt 51 which corresponds to the width of 3 mm and was untransferred to the photosensitive drum 1Y, the residual toner T corresponding to the width of 1 mm at the most downstream position will be transferred to the photosensitive drum 1M. Further, out of the residual toner T on the intermediate transfer belt 51 which corresponds to the length of 3 mm and was untransferred to the photosensitive drum 1Y, the residual toner T corresponding to the width of 2 mm at the upstream position will not be transferred to the photosensitive drum 1M and remains on the intermediate transfer belt 51. Then, the residual toner is further conveyed to a primary transfer nip portion BC.

Figure 6C:
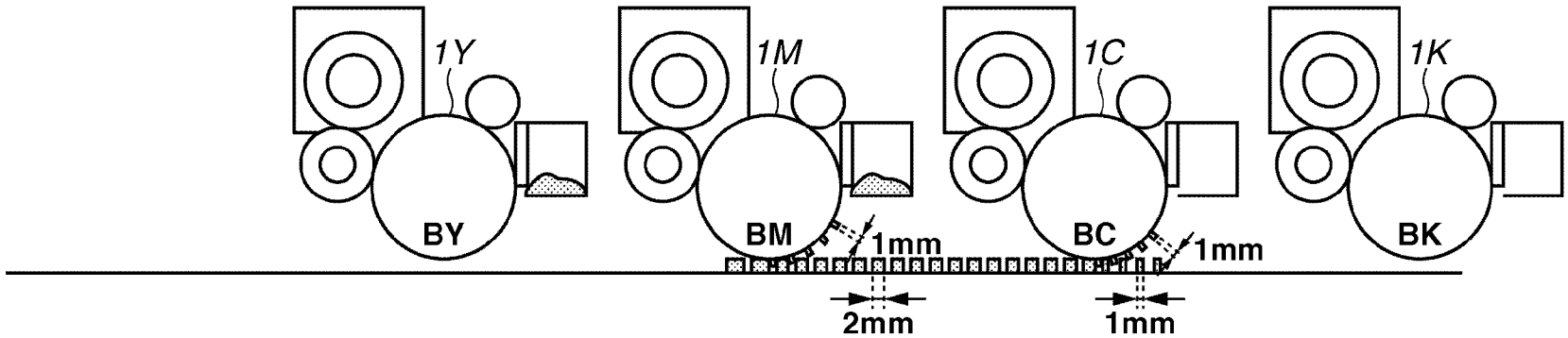
Figure 6D:
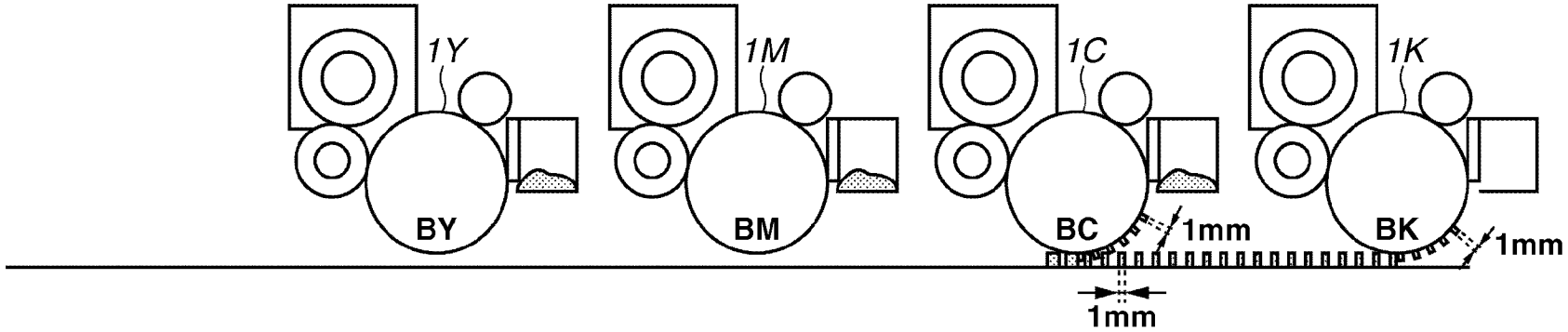

Similarly, as illustrated in FIG. 6C, out of the residual toner T on the intermediate transfer belt 51 which corresponds to the width of 2 mm and was untransferred to the photosensitive drum 1M, the residual toner T corresponding to the width of 1 mm at the downstream position will be transferred to the photosensitive drum 1C. Further, out of the residual toner T on the intermediate transfer belt 51 which corresponds to the length of 2 mm and was untransferred to the photosensitive drum 1M, the residual toner T corresponding to the width of 1 mm at the upstream position will not be transferred to the photosensitive drum 1C and remains on the intermediate transfer belt 51. Then, the residual toner is further conveyed to a primary transfer nip portion BK.

Then, all the residual toner that remains on the intermediate transfer belt 51 which corresponds to the length of 1 mm is transferred to the photosensitive drum 1K at the primary transfer nip portion BK. This is because the photosensitive drum 1K is constantly charged to negative polarity according to the second exemplary embodiment.

As described above, according to the second exemplary embodiment, all the residual toner T on the intermediate transfer belt 51 is intermittently transferred to each of the photosensitive drums 1Y, 1M, 1C, and 1K. Then, at the timing when the rotation driving of one turn of the intermediate transfer belt 51 ends, the bias application to the charging roller 2 and the bias application to the toner charging roller 12 are stopped. Further, immediately after the stop of the bias application to the charging roller 2 and the toner charging roller 12, the rotation driving of the intermediate transfer belt 51 is stopped, and the charging cleaning ends.

(Charging Cleaning Sequence after Emergency Stop of Image Forming Operation)

Figure 7:
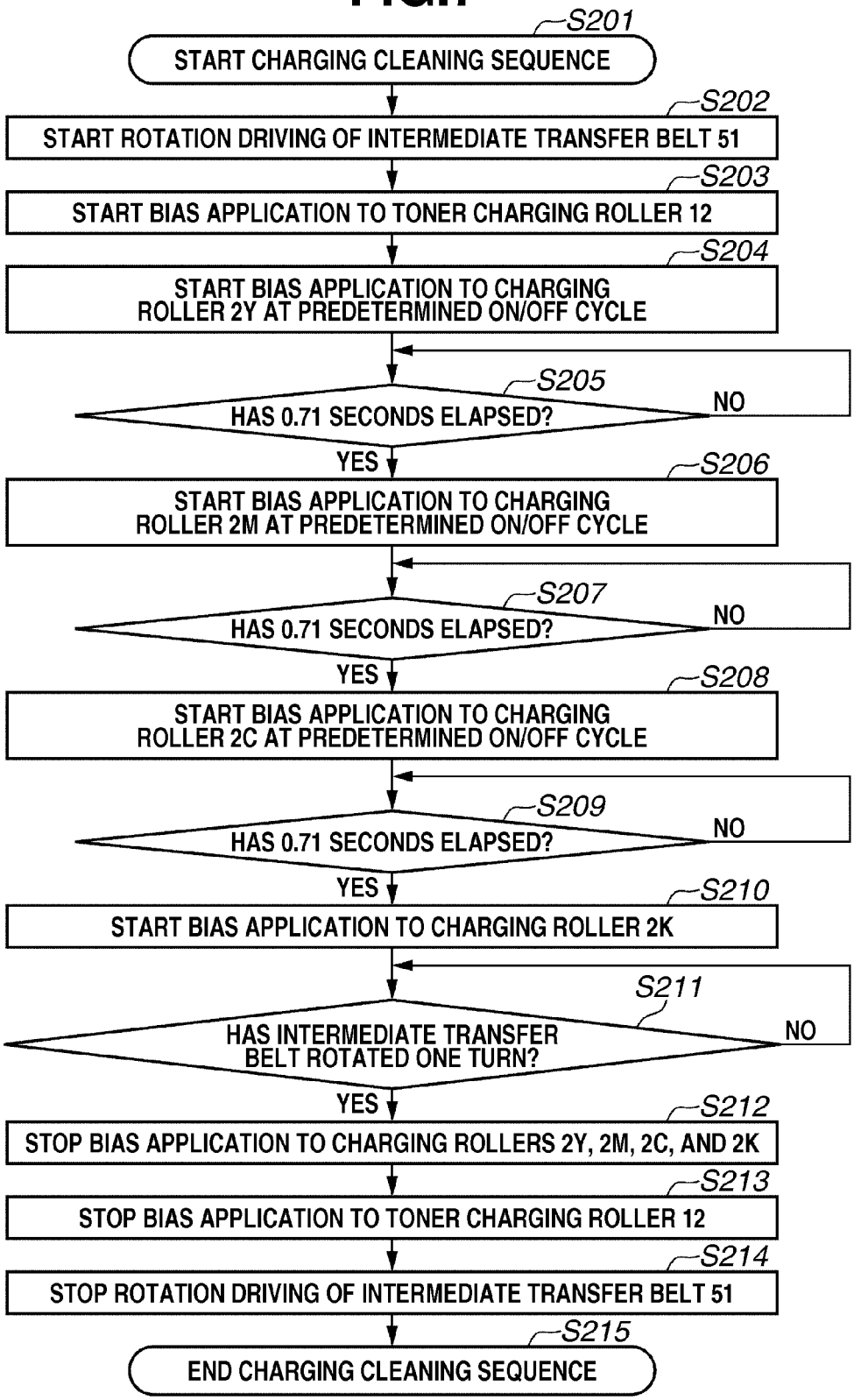
FIG. 7 is a flowchart illustrating the charging cleaning sequence according to the second exemplary embodiment.

Next, the charging cleaning sequence after the emergency stop of the image forming operation according to the second exemplary embodiment will be described with reference to FIG. 7. FIG. 7 is a flowchart illustrating the charging cleaning sequence according to the second exemplary embodiment.

In step S201, the charging cleaning sequence is started after the emergency stop of the image forming operation. In step S202, the control unit starts the rotation driving of the intermediate transfer belt 51. In step S203, the control unit starts the application of a bias of +2000 V to the toner charging roller 12. In step S204, the control unit starts the application of the bias of −1000 V to the charging roller 2Y at an ON/OFF cycle (0.01 second ON and 0.01 second OFF). In step S205, the control unit determines whether 0.71 seconds has elapsed from the start of the bias application to the charging roller 2Y at the on/off cycle. If the control unit determines that 0.71 seconds has elapsed (YES in step S205), the processing proceeds to step S206. In step S206, the control unit starts the application of the bias of −1000 V to the charging roller 2M at an ON/OFF cycle (0.01 second ON and 0.01 second OFF). On the other hand, in step S205, if the control unit determines that 0.71 seconds has not yet elapsed (NO in step S205), step S205 is repeated.

In step S207, the control unit determines whether 0.71 seconds has elapsed from the start of the bias application to the charging roller 2M at the on/off cycle. If the control unit determines that 0.71 seconds has elapsed (YES in step S207), the processing proceeds to step S208. In step S208, the control unit starts the application of the bias of −1000 V to the charging roller 2C at an ON/OFF cycle (0.01 second ON and 0.01 second OFF). On the other hand, in step S207, if the control unit determines that 0.71 seconds has not yet elapsed (NO in step S207), step S207 is repeated.

In step S209, the control unit determines whether 0.71 seconds has elapsed from the start of the ON/OFF cycle of the bias application to the charging roller 2C. If the control unit determines that 0.71 seconds has elapsed (YES in step S209), the processing proceeds to step S210. In step S210, the control unit starts the constant application of the bias of −1000 V to the charging roller 2K. On the other hand, in step S209, if the control unit determines that 0.71 seconds has not yet elapsed (NO in step S209), step S209 is repeated.

In step S211, the control unit determines whether the intermediate transfer belt 51 has rotated one turn from the start of the charging cleaning sequence. If the control unit determines that the intermediate transfer belt 51 has rotated one turn (YES in step S211), the processing proceeds to step S212. In step S212, the control unit stops the application of the bias to each of the charging rollers 2Y to 2K. In step S213, the control unit stops the application of the bias to the toner charging roller 12. In step S214, the control unit stops the rotation driving of the intermediate transfer belt 51. In step S215, the charging cleaning sequence according to the second exemplary embodiment ends. On the other hand, in step S211, if the control unit determines that the intermediate transfer belt 51 has not yet rotated one turn (NO in step S211), step S211 is repeated.

Next, the image forming apparatus according to a third exemplary embodiment will be described. Since the configuration of the image forming apparatus according to the third exemplary embodiment is similar to the configuration of the second exemplary embodiment (see FIG. 5), the description is not repeated.

(Charging Cleaning Operation after Emergency Stop of Image Forming Operation)

The charging cleaning operation according to the third exemplary embodiment will be described. According to the third exemplary embodiment, as is the case with the second exemplary embodiment, when the residual toner T on the intermediate transfer belt 51 is removed, it is distributed to each of the photosensitive drums 1Y to 1K, and all the residual toner T on the intermediate transfer belt 51 is collected in one turn of the intermediate transfer belt 51. However, according to the third exemplary embodiment, unlike the second exemplary embodiment, instead of turning on/off the bias application to the charging rollers 2Y to 2C, the residual toner T is intermittently transferred to the photosensitive drum 1 due to periodic exposure of each of the photosensitive drums 1Y to 1C by the laser scanner 3.

According to the third exemplary embodiment, immediately after the rotation driving of the intermediate transfer belt 51 is started, a bias of +2000 V is applied to the toner charging roller 12 and a bias of −1000 V is applied to each of the charging rollers 2Y to 2K. Thus, the residual toner T on the intermediate transfer belt 51 is charged to positive polarity when it passes the toner charging roller 12. Further, the photosensitive drums 1Y to 1K are constantly charged to negative polarity.

Figure 8:
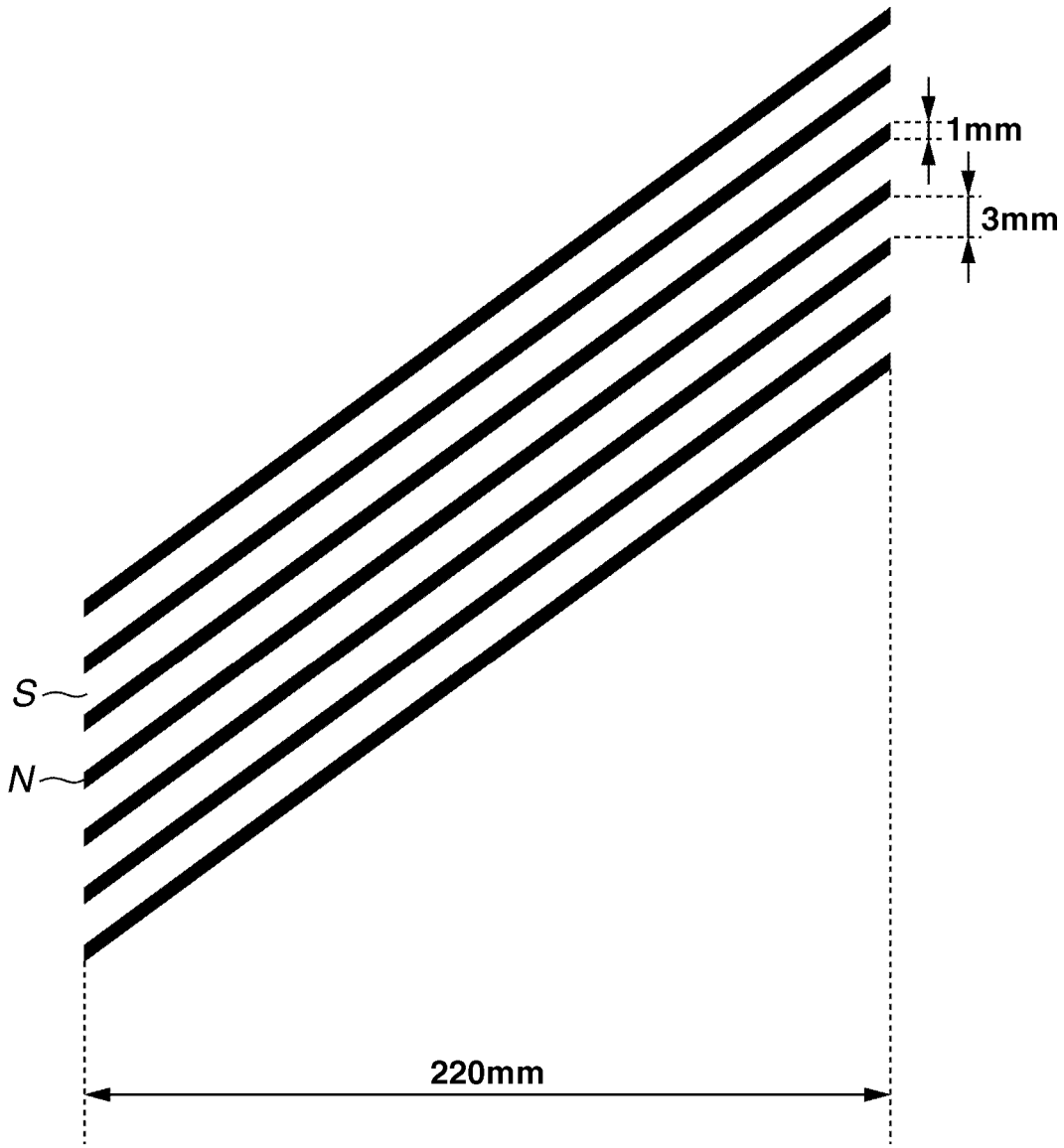
FIG. 8 illustrates a latent image to be formed on the photosensitive drum according to the third exemplary embodiment.

Then, each of the photosensitive drums 1Y to 1C is exposed to strong light emitted from the laser scanner 3, and a latent image, which is an image of a diagonal band, is formed on each of the photosensitive drums 1Y to 1C at predetermined intervals. FIG. 8 illustrates the latent image formed on the photosensitive drum 1 according to the third exemplary embodiment. The exposure intensity when the exposure is strong is 0.28 ($\mu J/cm^2$). More precisely, according to the third exemplary embodiment, a latent image S, which is an image of a parallelogram such as the diagonal band illustrated in FIG. 8, is formed on the photosensitive drum 1. The latent image S is 220 mm long in the axial direction of the photosensitive drum 1 and 3 mm long in the rotational direction of the photosensitive drum 1.

The area of the latent image S formed on the surface of the photosensitive drum 1 has no charges since substantially all the charges are discharged due to the strong exposure. A non-exposure portion N, which is a parallelogram-shaped area between two latent images S, is charged to negative polarity. As illustrated in FIG. 8, the non-exposure portion N is 220 mm long in the axial direction of the photosensitive drum 1 and 1 mm long in the rotational direction of the photosensitive drum 1. The non-exposure portion N is the area to which the residual toner T on the intermediate transfer belt 51 is transferred. On the other hand, the area of the latent image S is to which the residual toner T on the intermediate transfer belt 51 is not transferred.

According to the third exemplary embodiment, the exposure of the photosensitive drum 1K is not performed by the laser scanner 3 and the surface of the photosensitive drum 1K is constantly charged to negative polarity. Thus, the residual toner T on the intermediate transfer belt 51 is constantly transferred to the photosensitive drum 1K.

According to the third exemplary embodiment, as is the case with the second exemplary embodiment, the timing the exposure of the photosensitive drums 1Y to 1C is started by the laser scanner 3 is delayed by 0.71 seconds in the order of the photosensitive drums 1Y, 1M, and 1C. Accordingly, the portions of the residual toner T to be transferred to the surface of each of the photosensitive drums 1Y, 1M, 1C, and 1K in the moving direction do not overlap, and the residual toner T on the intermediate transfer belt 51 is transferred to the surface of each of the photosensitive drums 1Y, 1M, 1C, and 1K for a width of 1 mm in the rotational direction of the photosensitive drum 1.

(Charging Cleaning Sequence after Emergency Stop of Image Forming Operation)

Figure 9:
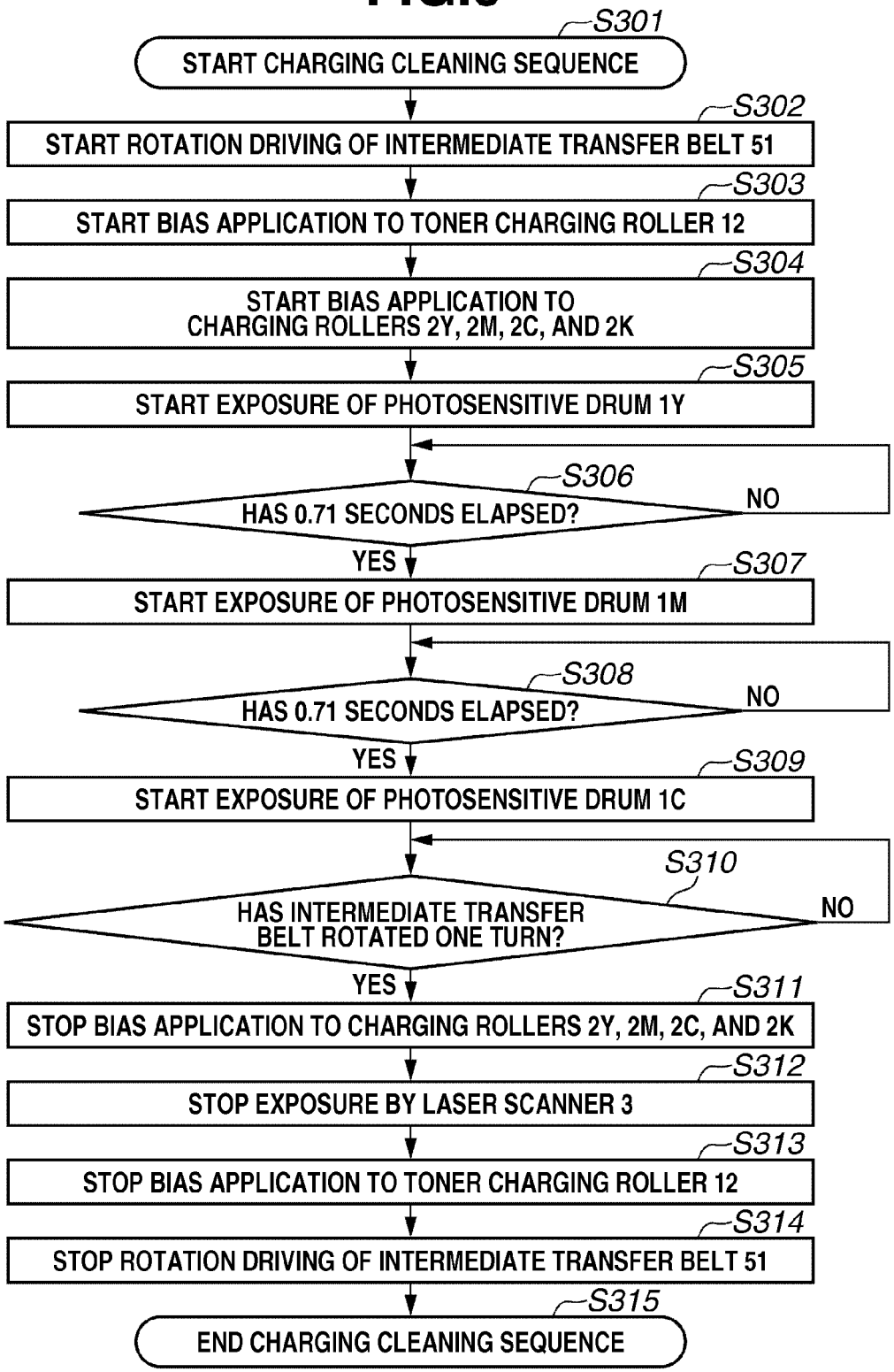
FIG. 9 is a flowchart illustrating the charging cleaning sequence according to the third exemplary embodiment.

Next, the flow of the charging cleaning sequence according to the third exemplary embodiment will be described with reference to FIG. 9. FIG. 9 is a flowchart illustrating the charging cleaning sequence according to the third exemplary embodiment.

In step S301, the charging cleaning sequence is started. In step S302, the control unit starts the rotation driving of the intermediate transfer belt 51. In step S303, the control unit applies a bias of +2000 V to the toner charging roller 12. In step S304, the control unit sequentially applies a bias of −1000 V to the charging rollers 2Y to 2K. In step S305, the control unit causes the laser scanner 3 to expose the surface of the photosensitive drum 1Y. Accordingly, the latent image S having the shape of a diagonal band is formed on the photosensitive drum 1Y.

In step S306, the control unit determines whether 0.71 seconds has elapsed from the start of the generation of the latent image S on the photosensitive drum 1Y. If the control unit determines that 0.71 seconds has elapsed (YES in step S306), the processing proceeds to step S307. In step S307, the control unit causes the laser scanner 3 to expose the surface of the photosensitive drum 1M. Accordingly, the latent image S having the shape of a diagonal band is formed on the surface of the photosensitive drum 1M. On the other hand, if the control unit determines that 0.71 seconds has not yet elapsed (NO in step S306), step S306 is repeated.

In step S308, the control unit determines whether 0.71 seconds has elapsed from the start of the generation of the latent image S on the photosensitive drum 1M. If the control unit determines that 0.71 seconds has elapsed (YES in step S308), the processing proceeds to step S309. In step S309, the control unit causes the laser scanner 3 to expose the surface of the photosensitive drum 1C. Accordingly, the latent image S having the shape of a diagonal band is formed on the photosensitive drum 1C. On the other hand, if the control unit determines that 0.71 seconds has not yet elapsed (NO in step S308), step S308 is repeated.

In step S310, the control unit determines whether the intermediate transfer belt 51 has rotated one turn from the start of the charging cleaning sequence. If the control unit determines that the intermediate transfer belt 51 has rotated one turn (YES in step S310), the processing proceeds to step S311. If the control unit determines that the intermediate transfer belt 51 has not yet rotated one turn (NO in step S310), step S310 is repeated. In step S311, the control unit stops the application of the bias to the charging rollers 2Y to 2K. In step S312, the control unit causes the laser scanner 3 to stop the exposure of each surface of the photosensitive drums 1Y to 1C. In step S313, the control unit stops the application of the bias to the toner charging roller 12. In step S314, the control unit stops the rotation driving of the intermediate transfer belt 51. In step S315, the charging cleaning sequence after the image forming operation ends.

Next, a first, a second, a third, and a fourth comparison examples will be described. Since the configurations of the image forming apparatus of the first to the fourth comparison examples are similar to the configuration of the first exemplary embodiment (see FIG. 1), their descriptions are not repeated.

According to the charging cleaning of the first comparison example, all the residual toner T that remains on the intermediate transfer belt 51 is not divided and transferred to the photosensitive drum 1 at one time. More precisely, in the charging cleaning sequence after the emergency stop of the image forming operation, the rotation driving of the intermediate transfer belt 51 is started. Then, immediately after the start of the rotation driving of the intermediate transfer belt 51, a bias of +2000 V is applied to the toner charging roller 12. Simultaneously, due to a constant application of a bias of −1000 V to the charging roller 2, the surface potential of the photosensitive drum 1 is uniformly charged to negative polarity. After the end of one turn of the intermediate transfer belt 51, the bias application to the charging roller 2 and the bias application to the toner charging roller 12 are stopped. Further, immediately after the stop of the bias application, the rotation driving of the intermediate transfer belt 51 is stopped, and the charging cleaning ends.

According to the charging cleaning of the second comparison example, by increasing, compared to the ON/OFF time of the first exemplary embodiment, the ON/OFF cycle of the bias applied to the charging roller 2, the number of times the residual toner T that remains on the intermediate transfer belt 51 is divided when the residual toner is transferred to the photosensitive drum 1 is reduced. More precisely, the ON/OFF cycle of the bias applied to the charging roller 2 is 0.20 seconds ON and 0.20 seconds OFF. Thus, the toner is received/not received by the cleaning blade 6*a* at intervals of 20 mm in an alternating manner.

According to the charging cleaning of the third comparison example, by increasing, compared to the ON/OFF cycle of the first exemplary embodiment, the ON/OFF cycle of the bias applied to the charging roller 2, the number of times the residual toner T that remains on the intermediate transfer belt 51 is divided when the residual toner is transferred to the photosensitive drum 1 is reduced. However, the number of times the residual toner T on the intermediate transfer belt 51 is divided when it is transferred to the photosensitive drum 1 according to the third comparison example is greater than the number of times the residual toner T is divided of the second comparison example. More precisely, the ON/OFF cycle of the bias applied to the charging roller 2 is 0.10 seconds ON and 0.10 seconds OFF. Accordingly, the toner is received/not received by the cleaning blade 6*a* at intervals of 10 mm in an alternating manner.

According to the charging cleaning of the fourth comparison example, by increasing, compared to the ON/OFF cycle of the first exemplary embodiment, the ON/OFF cycle of the bias applied to the charging roller 2, the number of times the residual toner T that remains on the intermediate transfer belt 51 is divided when the residual toner is transferred to the photosensitive drum 1 is reduced. However, the number of times the residual toner T on the intermediate transfer belt 51 is divided when it is transferred to the photosensitive drum 1 according to the fourth comparison example is greater than the number of times the residual toner T is divided of the comparison examples 2 and 3. More precisely, the ON/OFF cycle of the bias applied to the charging roller 2 is 0.05 seconds ON and 0.05 seconds OFF. Accordingly, the toner is received/not received by the cleaning blade 6*a* at intervals of 5 mm in an alternating manner.

(Presence/Absence of Defective Image Due to Poor Cleaning)

Next, presence/absence of a defective image caused by poor cleaning according to the first to the third exemplary embodiments and the first to the fourth comparison examples will be described. In Table 1 below, "Good" indicates that a defective image was not generated, "Slightly affected" indicates that a slightly defective image was generated, and "Poor" indicates that a defective image was generated.

According to the first and the second exemplary embodiments and the first to the fourth comparison examples, the presence/absence of the occurrence of the defective image has been determined under the following conditions. First, the image forming operation was executed without setting the recording material P in the sheet cassette 9. An A4-size solid secondary-color image was selected as the image to be formed. The top, right, bottom, and left margins were set to 5 mm. Then, during the image forming operation of the image forming apparatus, the operation was urgently stopped due to no-paper jam. Accordingly, toner corresponding to the A4-size solid secondary-color image was remained on the intermediate transfer belt 51. The solid secondary-color image was selected because the secondary color uses substantially the upper limit of the amount of toner when an image is actually formed by the image forming apparatus.

Then, the charging cleaning operation after the stop of the image forming operation was executed. After the execution of the charging cleaning sequence after the stop of the image forming operation, the recording material P was set in the sheet cassette 9 and an image forming operation of a half tone image was executed. Lastly, whether a defective image was generated due to poor charging cleaning was determined with respect to the half tone image printed on the recording material P. The obtained results are illustrated in Table 1.

As can be seen from Table 1, a defective image due to poor cleaning was not generated according to the image forming apparatus of the first and the second exemplary embodiments. On the contrary, according to the first to the third comparison examples, many vertical white streaks and vertical white bands due to poor cleaning of the charging roller 2 soiled with toner were generated. According to the fourth comparison example, a defective image having a slight vertical white streak was generated.

Further, according to the second and the third exemplary embodiments, a solid tertiary-color image was used for the determination of the generation of the defective image under conditions similar to those described above. The results are also illustrated in Table 1.

TABLE 1

| | Solid Secondary Colors | Solid Tertiary Colors |
|---|---|---|
| First exemplary embodiment | Good | N/A |
| First comparison example | Poor | N/A |
| Second comparison example | Poor | N/A |
| Third comparison example | Poor | N/A |
| Fourth comparison example | Slightly affected | N/A |
| Second exemplary embodiment | Good | Slightly affected |
| Third exemplary embodiment | N/A | Good |

As described above, according to the first exemplary embodiment, the presence/absence of the residual toner T to be received by the cleaning blade 6*a* is repeated in intervals of 1 mm. According to the second to the fourth comparison examples, the presence/absence of the residual toner T to be received by the cleaning blade 6*a* is repeated in intervals of 20 mm, 10 mm, and 5 mm. Thus, according to the first exemplary embodiment, the amount of toner to be received by the cleaning blade 6*a* at one time is smaller than the amount of toner to be received according to the first to the fourth comparison examples. Accordingly, reception of the toner by the cleaning blade 6*a* is stopped before the edge of the cleaning blade is bent in the rotational direction of the photosensitive drum 1 due to the pressure of the toner. Thus, according to the first exemplary embodiment, it is considered that the occurrence of defective image due to poor cleaning can be reduced.

Further, the level of the image was improved in the order of the first comparison example to the fourth comparison example. This is because the amount of toner to be received by the cleaning blade 6*a* is reduced in the order of the first comparison example to the fourth comparison example. According to the results of the first exemplary embodiment and the first to the fourth comparison examples, it can be determined that a width of around 1 mm is desirable as the division width of the residual toner to be transferred from the intermediate transfer belt 51 to the photosensitive drum 1. However, the division width of the residual toner appropriate for preventing poor cleaning depends on the material used for the cleaning blade 6*a* and the conditions of the bias applied to the charging roller 2 and the toner charging roller 12.

Further, generation of a defective image due to poor cleaning under the conditions of the solid tertiary-color image according to the second and the third exemplary embodiments will be described. As illustrated in Table 1, according to the third exemplary embodiment, a defective image due to poor cleaning was not generated. However, a slight vertical white streak was generated according to the second exemplary embodiment. In other words, although the second and the third exemplary embodiments have a substantially same division width of the residual toner T, which is on the intermediate transfer belt 51 and to be transferred to the photosensitive drum 1, the third exemplary embodiment showed that the poor cleaning was less likely to occur.

Figure 10A:
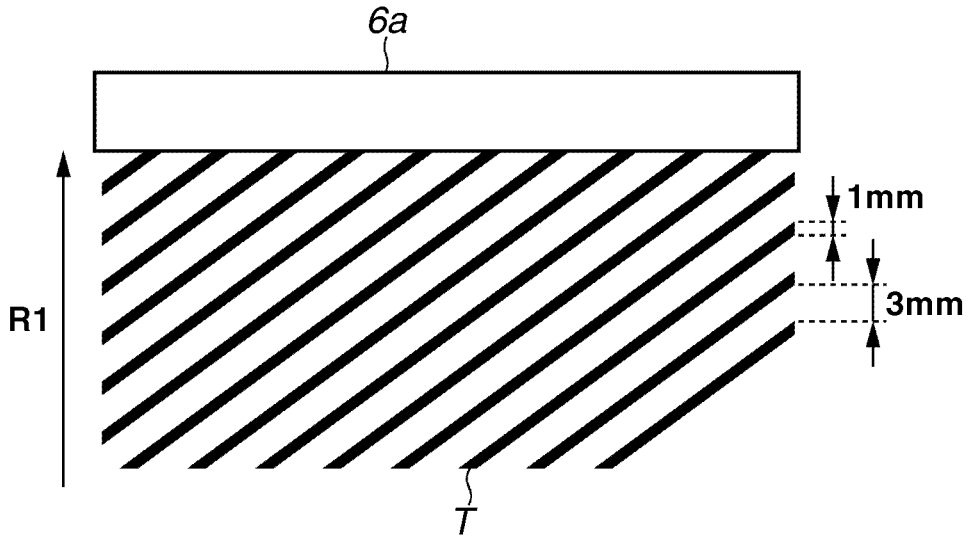
FIGS. 10A and 10B illustrate a latent image to be formed on the photosensitive drum according to the second and the third exemplary embodiments.
Figure 10B:
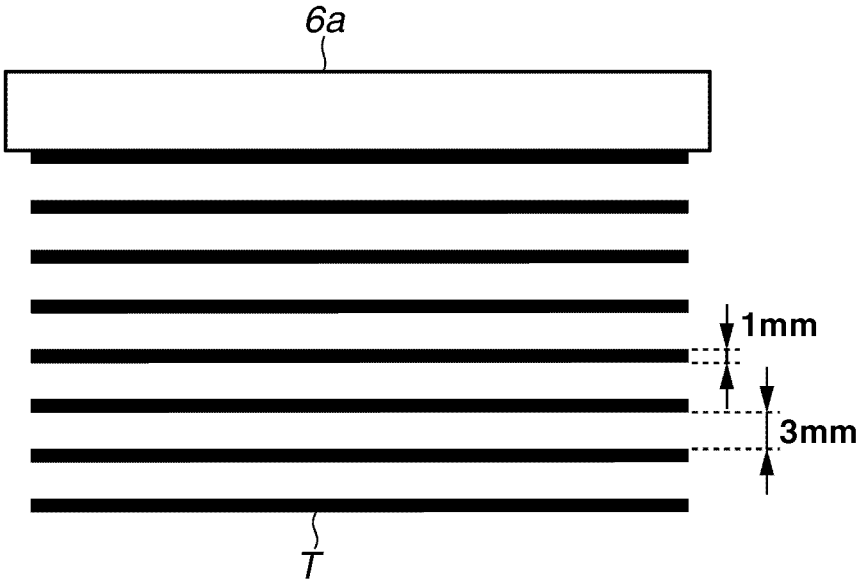

FIG. 10A illustrates a latent image formed on the photosensitive drum according to the third exemplary embodiment and FIG. 10B illustrates a latent image formed on the photosensitive drum according to the second exemplary embodiment. According to the third exemplary embodiment, since the residual toner T is transferred to the photosensitive drum 1 in a shape of a diagonal band, as illustrated in FIG. 10A, the residual toner T transferred to the photosensitive drum 1 is received by the cleaning blade 6*a* from the diagonal direction with respect to the longitudinal direction of the cleaning blade 6*a*. Thus, the residual toner T is received only by part of the cleaning blade 6*a* in the longitudinal direction contact. On the other hand, according to the second exemplary embodiment, as illustrated in FIG. 10B, since the residual toner T is received by the cleaning blade 6*a* from the direction parallel to the longitudinal direction of the cleaning blade 6*a*, the residual toner T is received in almost the full longitudinal width of the cleaning blade.

According to the third exemplary embodiment, when only some portions of the cleaning blade 6*a* in the longitudinal direction receive the toner, the rest of the portions of the cleaning blade 6*a* contributes to preventing the portions of the cleaning blade that receives the toner from being deformed. Thus, poor cleaning can be reduced.

However, for example, if the residual toner T is transferred to the photosensitive drum 1 in a longitudinal band, since the residual toner constantly received by the same longitudinal portions of the cleaning blade 6*a*, the cleaning blade 6*a* will be greatly deformed at such portions. As a result, poor cleaning occurs. Thus, it is desirable to have the cleaning blade 6*a* receive the toner in a diagonal band as the third exemplary embodiment, so that the longitudinal positions of the cleaning blade 6*a* that receive the toner is changed according to the rotation of the photosensitive drum 1.

As described above, according to the third exemplary embodiment, when the residual toner T on the intermediate transfer belt 51 is transferred to the photosensitive drum 1 in a plurality number of times, since the band of the residual toner T is not lateral but diagonal, poor cleaning of the cleaning blade 6*a* can be reduced more easily.

According to the present invention, the possibility of the generation of a defective image due to a large amount of developer conveyed to the cleaning unit at a time and the developer slipping through the cleaning unit can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-181853 filed Aug. 20, 2012, which is hereby incorporated by reference herein in its entirety.

What is claimed is:

1. An image forming apparatus comprising:

an image bearing member configured to rotate;

a first charging unit configured to charge a surface of the image bearing member;

an exposure unit configured to expose the surface of the image bearing member;

a developing unit configured to form a developer image by supplying developer on the image bearing member;

an intermediate transfer member configured to move for circulation;

a primary transfer unit facing the image bearing member via the intermediate transfer member and configured to primary-transfer the developer image formed on the image bearing member to the intermediate transfer member;

a secondary transfer unit configured to secondary-transfer the developer image to a recording medium;

a stopping unit configured to stop an image forming operation during the operation;

a second charging unit configured to charge the developer on the intermediate transfer member; and a cleaning unit configured to remove the developer on the image bearing member, wherein the image forming apparatus executes, after the stopping unit stops the image forming operation, a cleaning operation, in which residual developer that remains on the intermediate transfer member is transferred to the image bearing member and is removed by the cleaning unit, by causing the second charging unit to charge the developer that remains on the intermediate transfer member to a polarity opposite a surface potential of the image bearing member charged by the first charging unit, and wherein, when the cleaning operation is executed, one of the first charging unit and the exposure unit changes the surface potential of the image bearing member at predetermined intervals such that a first developer, that is some residual developer, is transferred from the intermediate transfer member to the image bearing member in at least one turn of the intermediate transfer member and a second developer, that is some residual developer and is the same polarity as the first developer, remains on the intermediate transfer member.

2. The image forming apparatus according to claim 1, wherein a plurality of the image bearing members is provided along a moving direction for circulation of the intermediate transfer member, and wherein, when the cleaning operation is executed, the first charging unit or the exposure unit changes the surface potential of the plurality of the image bearing members at predetermined intervals such that the developer to be transferred to the image bearing member at a most upstream position in the moving direction for circulation is part of the developer that is to remain on the intermediate transfer member.

3. The image forming apparatus according to claim 1, wherein, when the cleaning operation is executed, the first charging unit charges the surface of the image bearing member such that an area where the developer is transferred and an area where the developer is not transferred, from the intermediate transfer member to the image bearing member, are formed at predetermined intervals.

4. The image forming apparatus according to claim 1, wherein, when the cleaning operation is executed, after the first charging unit uniformly charges the surface of the image bearing member, the exposure unit exposes the surface of the image bearing member such that the area where the developer is not transferred from the intermediate transfer member to the image bearing member is formed in a diagonal band shape with respect to a rotational direction of the image bearing member.

5. The image forming apparatus according to claim 1, wherein when the cleaning unit removes the developer, the image bearing member has a first surface potential and a second surface potential different form the first surface potential.

6. The image forming apparatus according to claim 1, wherein when the cleaning unit removes the developer, the image bearing member has band-shaped regions in which adjacent regions are different in potential.

7. The image forming apparatus according to claim 1, wherein when the cleaning unit removes the developer, the surface of the image bearing member includes regions where adjacent regions are different in potential and where the regions are arranged at intervals.

8. An image forming apparatus comprising:

a charging unit configured to charge a surface of an image bearing member;

a developing unit configured to form a developer image by supplying developer on the image bearing member;

an intermediate transfer member configured to move for circulation;

a primary transfer unit facing the image bearing member via the intermediate transfer member and configured to primary-transfer the developer image formed on the image bearing member to the intermediate transfer member;

a secondary transfer unit configured to secondary-transfer the developer image to a recording medium; and a cleaning unit configured to remove the developer on the image bearing member, wherein the image forming apparatus executes, after the image forming operation is stopped, a cleaning operation, in which residual developer that remains on the intermediate transfer member is transferred to the image bearing member and is removed by the cleaning unit, and wherein, when the cleaning operation is executed, one of the charging unit and the exposure unit changes the surface potential of the image bearing member such that a first developer, that is some residual developer, is transferred from the intermediate transfer member to the image bearing member and a second developer, that is some residual developer and is the same polarity of the first developer, remains on the intermediate transfer member.

9. The image forming apparatus according to claim 8, wherein the surface potential of the image bearing member is changed at predetermined intervals.

10. The image forming apparatus according to claim 8, wherein, by charging the developer that remains on the intermediate transfer member, the developer that remains on the intermediate transfer member is transferred to the image bearing member and is removed by the cleaning unit.

11. The image forming apparatus according to claim 10, wherein the developer that remains on the intermediate transfer member is charged to a polarity opposite the surface potential of the image bearing member charged by the charging unit.

12. The image forming apparatus according to claim 11, wherein the charging is performed in at least one turn of movement for circulation of the intermediate transfer member.

13. The image forming apparatus according to claim 8, further comprising, when the charging unit is a first charging unit, in addition to the first charging unit, a second charging unit is configured to charge the developer on the intermediate transfer member.

14. The image forming apparatus according to claim 8, wherein when the cleaning operation is executed, the image bearing member has a first surface potential and a second surface potential different form the first surface potential.

15. The image forming apparatus according to claim 8, wherein when the cleaning operation is executed, the image bearing member has band-shaped regions in which adjacent regions are different in potential.

16. The image forming apparatus according to claim 8, wherein when the cleaning unit removes the developer, the surface of the image bearing member includes regions where adjacent regions are different in potential and where the regions are arranged at intervals.

* * * * *